US012799644B2

(12) United States Patent
Podhajny et al.

(10) Patent No.: US 12,799,644 B2
(45) Date of Patent: Nov. 17, 2026

(54) FABRIC SEAM WITH ELECTRICAL COMPONENTS

(71) Applicant: Apple Inc., Cupertino, CA (US)

(72) Inventors: Daniel A Podhajny, Morgan Hill, CA (US); Linda D Benavente-Notaro, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 646 days.

(21) Appl. No.: 17/840,508

(22) Filed: Jun. 14, 2022

(65) Prior Publication Data

US 2023/0008099 A1 Jan. 12, 2023

Related U.S. Application Data

(60) Provisional application No. 63/220,912, filed on Jul. 12, 2021.

(51) Int. Cl.
*D03D 1/00* (2006.01)
*A41D 1/00* (2018.01)
(Continued)

(52) U.S. Cl.
CPC ..... *D03D 1/0088* (2013.01); *A41D 1/002* (2013.01); *A41D 27/00* (2013.01); *A41D 27/205* (2013.01);
(Continued)

(58) Field of Classification Search
CPC ..... Y10T 428/19; Y10T 442/00; D10B 2401/041; D10B 2401/18; D10B 2403/03;
(Continued)

(56) References Cited

U.S. PATENT DOCUMENTS 6,324,053 B1 * 11/2001 Kamijo ..... G06F 1/163 2/905
6,727,197 B1 * 4/2004 Wilson ..... D04C 1/02 87/8
(Continued)

FOREIGN PATENT DOCUMENTS

CN 102488334 A 6/2012
CN 205295656 U 6/2016
(Continued)

OTHER PUBLICATIONS

"Types of Seams and Their Uses"; ABC Seams, https://abcseams.com (Year: 2020).*
(Continued)

*Primary Examiner* — Jennifer A Steele
(74) *Attorney, Agent, or Firm* — Treyz Law Group, P.C.; Kendall P. Woodruff

(57) ABSTRACT

One or more electrical components may be incorporated into a fabric seam. The fabric seam may join two pieces of material in a fabric item or may form the border of a fabric item. The fabric seam may include first and second fabric portions with one or more conductive strands extending between the first and second fabric portions. An electrical component may be coupled to the conductive strand. The fabric seam may have one or more side pockets for capturing the edge of a material such as a piece of fabric. The fabric seam may have gaps that allow conductive strands within the fabric seam to branch off in different directions. Openings may be incorporated in the fabric seam to allow air or light to pass through and/or to form a window for an electrical component in the fabric seam.

19 Claims, 12 Drawing Sheets

(51) Int. Cl.

| | |
|---|---|
| ***A41D 27/00*** | (2006.01) |
| ***A41D 27/20*** | (2006.01) |
| ***A41D 27/24*** | (2006.01) |
| ***D04B 21/14*** | (2006.01) |

(52) U.S. Cl.
CPC ..... *A41D 27/24* (2013.01); *D04B 21/14* (2013.01); *D10B 2401/18* (2013.01)

(58) Field of Classification Search
CPC .... D10B 2403/02431; D10B 2403/033; D10B 2403/0331; D10B 2403/0333
See application file for complete search history.

(56) References Cited

U.S. PATENT DOCUMENTS

| | | | | |
|---|---|---|---|---|
| 7,022,917 | B2 | 4/2006 | Jung et al. | |
| 8,308,489 | B2 * | 11/2012 | Lee | H01R 13/2407 439/37 |
| 9,032,762 | B2 * | 5/2015 | Begriche | D04B 1/22 66/171 |
| 9,282,893 | B2 | 3/2016 | Longinotti-Buitoni et al. | |
| 10,045,439 | B2 * | 8/2018 | Longinotti-Buitoni | D06M 15/263 |
| 10,174,444 | B1 | 1/2019 | Podhajny et al. | |
| 10,274,384 | B2 | 4/2019 | Dunne et al. | |
| 10,462,898 | B2 | 10/2019 | Longinotti-Buitoni et al. | |
| 10,485,103 | B1 | 11/2019 | Sunshine et al. | |
| 10,653,190 | B2 | 5/2020 | Longinotti-Buitoni et al. | |
| 2004/0009731 | A1 * | 1/2004 | Rabinowicz | A61N 1/04 2/456 |
| 2007/0049147 | A1 | 3/2007 | Hill et al. | |
| 2008/0143080 | A1 * | 6/2008 | Burr | D04B 1/246 280/495 |
| 2009/0035530 | A1 | 2/2009 | Speich | |
| 2009/0146790 | A1 | 6/2009 | Speich | |
| 2009/0200066 | A1 * | 8/2009 | Vicard | G06K 19/07749 174/255 |
| 2010/0051699 | A1 | 3/2010 | Speich | |
| 2010/0085166 | A1 | 4/2010 | Speich | |
| 2016/0356449 | A1 | 12/2016 | Jorro de Inza et al. | |
| 2017/0247820 | A1 * | 8/2017 | Podhajny | D03D 1/0088 |
| 2017/0251555 | A1 * | 8/2017 | Sunshine | D03D 15/533 |
| 2018/0195218 | A1 * | 7/2018 | Hamada | D04B 27/32 |
| 2018/0199635 | A1 * | 7/2018 | Longinotti-Buitoni | A61B 5/0205 |
| 2019/0013274 | A1 | 1/2019 | Sunshine et al. | |
| 2020/0283935 | A1 * | 9/2020 | Chatham | B32B 7/12 |
| 2021/0045685 | A1 | 2/2021 | Keating et al. | |

FOREIGN PATENT DOCUMENTS

| | | | | | |
|---|---|---|---|---|---|
| CN | 206359734 | U | | 7/2017 | |
| CN | 107002318 | A | | 8/2017 | |
| CN | 107923081 | A | | 4/2018 | |
| CN | 208562684 | U | | 3/2019 | |
| DE | 102008034937 | A1 | | 2/2010 | |
| DE | 102017100553 | A1 | | 7/2018 | |
| GB | 2615480 | A | * | 8/2023 | A41B 1/00 |
| KR | 101839702 | B1 | * | 3/2018 | A41D 27/08 |
| WO | 2005071605 | A2 | | 8/2005 | |
| WO | 2006029543 | A1 | | 3/2006 | |
| WO | 2008011739 | A1 | | 1/2008 | |
| WO | 2008034269 | A1 | | 3/2008 | |
| WO | 2008098386 | A1 | | 8/2008 | |
| WO | 2009000446 | A1 | | 12/2008 | |
| WO | 2009003299 | A1 | | 1/2009 | |
| WO | 2011095241 | A1 | | 8/2011 | |
| WO | 2011154449 | A1 | | 12/2011 | |
| WO | 2013026697 | A1 | | 2/2013 | |
| WO | 2016048741 | A1 | | 3/2016 | |
| WO | 2016062463 | A1 | | 4/2016 | |
| WO | 2017042015 | A1 | | 3/2017 | |
| WO | 2017216117 | A1 | | 12/2017 | |
| WO | 2018010944 | A1 | | 1/2018 | |
| WO | WO-2020185523 | A1 | * | 9/2020 | B23K 1/0008 |

OTHER PUBLICATIONS

Machine Translation KR101839702 (Year: 2018).*
Annett Dorfel et al: "Entwicklung von Losungen zum Einweben von Inserts auf Band-und Breitwebmaschinen für Smart Textiles und Automobiltextilien" Jan. 13, 2011 (Jan. 13, 2011), XP055112401, Retrieved from the Internet: URL:http://tu-dresden.de/die_tu_dresden/fakultaeten/fakultaetmaschinenwesen/itm/forschung/forschungsthemen/inserts/index_html [retrieved on Apr. 7, 2014] p. 2, paragraph 4—p. 6, paragraph 1.

* cited by examiner

FABRIC SEAM WITH ELECTRICAL COMPONENTS

This application claims priority to provisional patent application No. 63/220,912, filed Jul. 12, 2021, which is hereby incorporated by reference herein in its entirety.

FIELD

This relates generally to items with fabric and, more particularly, to items with fabric and electrical components.

BACKGROUND

It may be desirable to form bags, furniture, clothing, and other items from materials such as fabric. Fabric items generally do not include electrical components. It may be desirable, however, to incorporate electrical components into fabric to provide a user of a fabric item with enhanced functionality.

It can be challenging to incorporate electrical components into fabric. Fabric is flexible, so it can be difficult to mount structures to fabric. Electrical components must be coupled to signal paths (e.g., signal paths that carry data signals, power, etc.), but unless care is taken, signal paths may be damaged, or components may become dislodged as fabric is bent or stretched.

It would therefore be desirable to be able to provide improved techniques for incorporating electrical components into items with fabric.

SUMMARY

Interlacing equipment (e.g., weaving equipment, knitting equipment, braiding equipment, etc.) may be provided with individually adjustable components. The use of individually adjustable components may allow electrical components to be inserted into and/or embedded in the fabric during the creation or formation of the fabric.

The interlacing equipment may create a gap between first and second fabric portions during interlacing operations. The gap may be a void between fabric portions or the gap may be a position or location between fabric portions. An insertion tool may insert an electrical component into the gap, and the electrical component may be electrically coupled to conductive strands in the gap.

The interlacing equipment may be used to create a fabric seam and to embed one or more electrical components within the fabric seam. The fabric seam may join two pieces of material or may form the border of a piece of material. The fabric seam may include first and second fabric portions with one or more conductive strands extending between the first and second fabric portions. An electrical component may be coupled to the conductive strand and may have a groove in which the conductive strand is soldered or otherwise attached.

The fabric seam may have one or more side pockets for capturing the edge of a material such as a piece of fabric. The piece of fabric may be stitched within the side pocket or bonded within the side pocket using adhesive or fusible strands that have been melted. The fabric seam may have gaps that allow conductive strands within the fabric seam to branch off in different directions. Openings may be incorporated in the fabric seam to allow air or light to pass through and/or to form a window for an electrical component in the fabric seam.

DETAILED DESCRIPTION

Electronic devices, enclosures, and other items may be formed from fabric such as woven fabric. The woven fabric may include strands of insulating and conductive material. Conductive strands may form signal paths through the fabric and may be coupled to electrical components such as light-emitting diodes and other light-emitting devices, integrated circuits, sensors, haptic output devices, and other circuitry.

Interlacing equipment (sometimes referred to as intertwining equipment) may include weaving equipment, knitting equipment, braiding equipment, or any other suitable equipment used for crossing, looping, overlapping, or otherwise coupling strands of material together to form a network of strands (e.g., fabric). Interlacing equipment may be provided with individually adjustable components such as warp strand positioning equipment (e.g., heddles or other warp strand positioning equipment), weft strand positioning equipment, a reed, take-down equipment, let off equipment (e.g., devices for individually dispensing and tensioning warp strands), needle beds, feeders, guide bars, strand processing and component insertion equipment, and other components for forming fabric items. The individual adjustability of these components may allow interlacing operations (e.g., weaving operations, knitting operations, braiding operations, and/or other interlacing operations) to be performed without requiring continuous lock-step synchronization of each of these devices, thereby allowing fabric with desired properties to be woven. As an example, normal reed movement and other weaving operations may be periodically suspended and/or may periodically be out-of-sync with other components to accommodate component insertion operations whereby electrical components (sometimes referred to as nodes or smart nodes) are inserted into the fabric during the creation or formation of the fabric.

Figure 1:
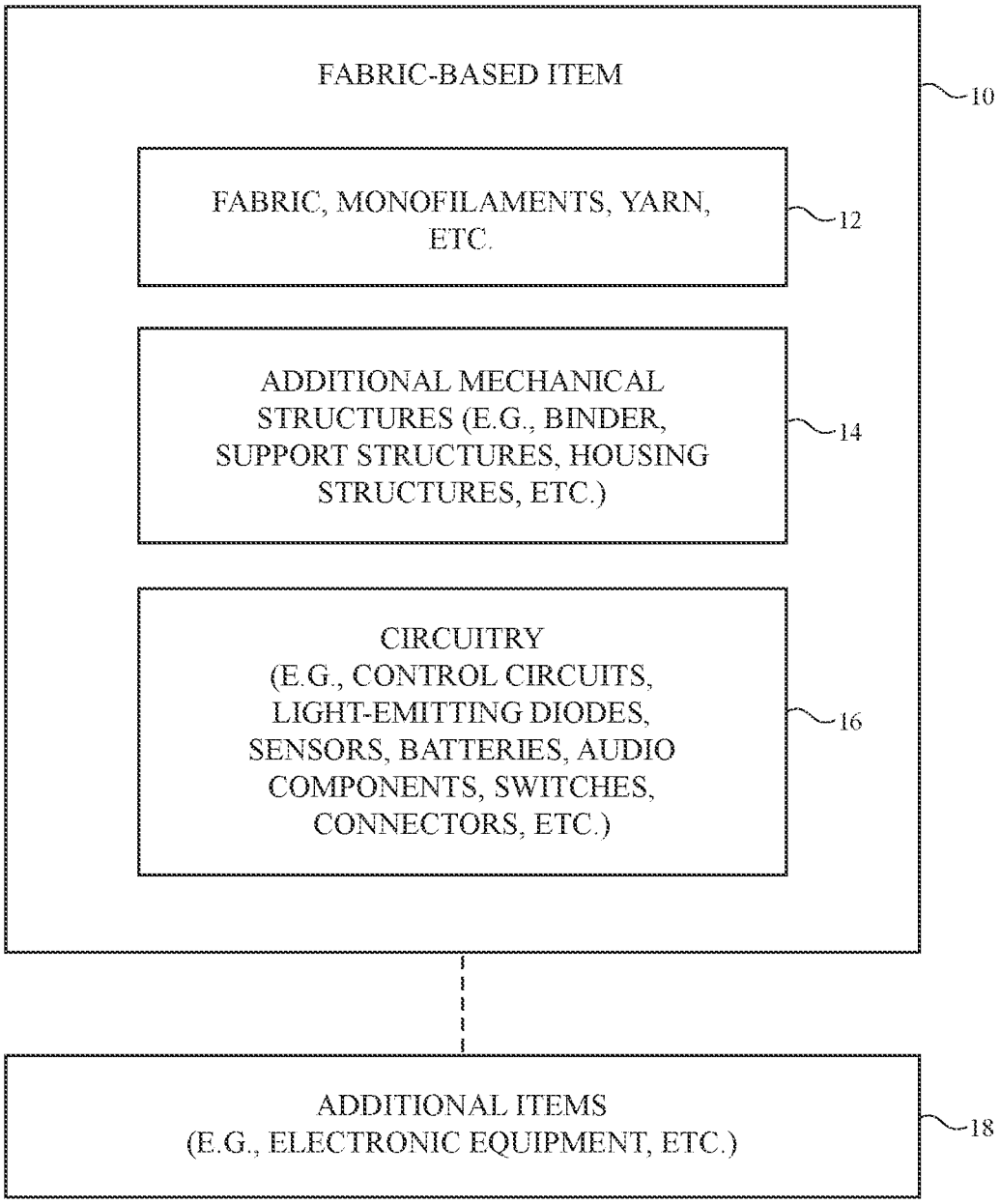
FIG. 1 is a schematic diagram of an illustrative fabric item in accordance with an embodiment.

Items such as item 10 of FIG. 1 may include fabric and may sometimes be referred to as a fabric item or fabric-based item. Item 10 may be an electronic device or an accessory for an electronic device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which fabric item 10 is mounted in a kiosk, in an automobile, airplane, or other vehicle (e.g., an autonomous or non-autonomous vehicle), other electronic equipment, or equipment that implements the functionality of two or more of these devices. If desired, item 10 may be a removable external case for electronic equipment, may be a strap, may be a wrist band or head band, may be a removable cover for a device, may be a case or bag that has straps or that has other structures to receive and carry electronic equipment and other items, may be a necklace or arm band, may be a wallet, sleeve, pocket, or other structure into which electronic equipment or other items may be inserted, may be part of a chair, sofa, or other seating (e.g., cushions or other seating structures), may be part of an item of clothing or other wearable item (e.g., a hat, belt, wrist band, headband, etc.), or may be any other suitable item that incorporates fabric.

Item 10 may include interlaced strands of material such as monofilaments and yarns that form fabric 12. As used herein, "interlaced" strands of material and "intertwined" strands of material may both refer to strands of material that are crossed with one another, looped with one another, overlapping one another, or otherwise coupled together (e.g., as part of a network of strands that make up a fabric). Fabric 12 may form all or part of a housing wall or other layer in an electronic device, may form internal structures in an electronic device, or may form other fabric-based structures. Item 10 may be soft (e.g., item 10 may have a fabric surface that yields to a light touch), may have a rigid feel (e.g., the surface of item 10 may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials.

The strands of material used in forming fabric 12 may be single-filament strands (sometimes referred to as fibers) or may be threads, yarns, or other strands that have been formed by interlacing multiple filaments of material together. Strands may be formed from polymer, metal, glass, graphite, ceramic, natural materials such as cotton or bamboo, or other organic and/or inorganic materials and combinations of these materials. Conductive coatings such as metal coatings may be formed on non-conductive strands (e.g., plastic cores) to make them conductive. Reflective coatings such as metal coatings may be applied to strands to make them reflective. Strands may also be formed from single-filament metal wire (e.g., bare metal wire), multifilament wire, or combinations of different materials. Strands may be insulating or conductive.

Strands in fabric 12 may be conductive along their entire lengths or may have conductive portions. Strands may have metal portions that are selectively exposed by locally removing insulation (e.g., to form connections with other conductive strand portions and/or to form connections with electrical components). Strands may also be formed by selectively adding a conductive layer to a portion of a non-conductive strand). Threads and other multifilament yarns that have been formed from interlaced filaments may contain mixtures of conductive strands and insulating strands (e.g., metal strands or metal coated strands with or without exterior insulating layers may be used in combination with solid plastic strands or natural strands that are insulating). In some arrangements, which may sometimes be described herein as an example, fabric 12 may be a woven fabric and the strands that make up fabric 12 may include warp strands and weft strands.

Conductive strands and insulating strands may be woven, knit, or otherwise interlaced to form conductive paths. The conductive paths may be used in forming signal paths (e.g., signal buses, power lines for carrying power, etc.), may be used in forming part of a capacitive touch sensor electrode, a resistive touch sensor electrode, or other input-output device, or may be used in forming other patterned conductive structures. Conductive structures in fabric 12 may be used in carrying electrical current such as power, digital signals, analog signals, sensor signals, control signals, data, input signals, output signals, or other suitable electrical signals.

Item 10 may include additional mechanical structures 14 such as polymer binder to hold strands in fabric 12 together, support structures such as frame members, housing structures (e.g., an electronic device housing), and other mechanical structures.

To enhance mechanical robustness and electrical conductivity at strand-to-strand connections and/or strand-to-component connections, additional structures and materials (e.g., solder, crimped metal connections, welds, conductive adhesive such as anisotropic conductive film and other conductive adhesive, non-conductive adhesive, fasteners, etc.) may be used in fabric 12. Strand-to-strand connections may be formed where strands cross each other perpendicularly or at other strand intersections where connections are desired. Insulating material can be interposed between intersecting conductive yarns at locations in which it is not desired to form a strand-to-strand connection. The insulating material may be plastic or other dielectric, may include an insulating strand or a conductive strand with an insulating coating or insulated conductive monofilaments, etc. Solder connections may be formed between conductive strands and/or between conductive strands and electrical components by melting solder so that the solder flows over conductive strands. The solder may be melted using an inductive soldering head to heat the solder, using hot air to heat the solder, using a reflow oven to heat the solder, using a laser or hot bar to heat the solder, or using other soldering equipment. In some arrangements, outer dielectric coating layers (e.g., outer polymer layers) may be melted away in the presence of molten solder, thereby allowing underlying metal yarns to be soldered together. In other arrangements, outer dielectric coating layers may be removed prior to soldering (e.g., using laser ablation equipment or other coating removal equipment).

Circuitry 16 may be included in item 10. Circuitry 16 may include electrical components that are coupled to fabric 12, electrical components that are housed within an enclosure formed by fabric 12, electrical components that are attached to fabric 12 using welds, solder joints, adhesive bonds (e.g., conductive adhesive bonds such as anisotropic conductive adhesive bonds or other conductive adhesive bonds), crimped connections, or other electrical and/or mechanical bonds. Circuitry 16 may include metal structures for carrying current, electrical components such as integrated circuits, light-emitting diodes, sensors, and other electrical devices. Control circuitry in circuitry 16 may be used to control the operation of item 10 and/or to support communications with item 18 and/or other devices.

Item 10 may interact with electronic equipment or other additional items 18. Items 18 may be attached to item 10 or item 10 and item 18 may be separate items that are configured to operate with each other (e.g., when one item is a case and the other is a device that fits within the case, etc.). Circuitry 16 may include antennas and other structures for supporting wireless communications with item 18. Item 18 may also interact with item 10 using a wired communications link or other connection that allows information to be exchanged.

In some situations, item 18 may be an electronic device such as a cellular telephone, computer, or other portable electronic device and item 10 may form a cover, case, bag, or other structure that receives the electronic device in a pocket, an interior cavity, or other portion of item 10. In other situations, item 18 may be a wrist-watch device or other electronic device and item 10 may be a strap or other fabric item that is attached to item 18 (e.g., item 10 and item 18 may together form a fabric-based item such as a wrist-watch with a strap). In still other situations, item 10 may be an electronic device, fabric 12 may be used in forming the electronic device, and additional items 18 may include accessories or other devices that interact with item 10. Signal paths formed from conductive yarns and monofilaments may be used to route signals in item 10 and/or item(s) 18.

The fabric that makes up item 10 may be formed from yarns and/or monofilaments that are interlaced using any suitable interlacing equipment. With one suitable arrangement, which may sometimes be described herein as an example, fabric 12 may be woven fabric formed using a weaving machine. In this type of illustrative configuration, fabric may have a plain weave, a basket weave, a satin weave, a twill weave, or variations of these weaves, may be a three-dimensional woven fabric, or may be other suitable fabric. This is, however, merely illustrative. If desired, fabric 12 may include knit fabric, warp knit fabric, weft knit fabric, braided fabric, other suitable type of fabric, and/or a combination of any two or more of these types of fabric.

Figure 2:
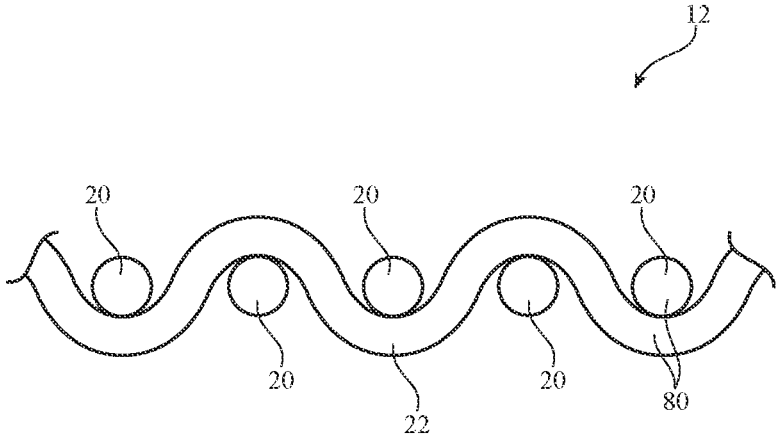
FIG. 2 is a side view of illustrative fabric in accordance with an embodiment.

A cross-sectional side view of illustrative woven fabric 12 is shown in FIG. 2. As shown in FIG. 2, fabric 12 may include strands 80. Strands 80 may include warp strands 20 and weft strands 22. If desired, additional strands that are neither warp nor weft strands may be incorporated into fabric 12. The example of FIG. 2 is merely illustrative. In the illustrative configuration of FIG. 2, fabric 12 has a single layer of woven strands 80. Multi-layer fabric constructions may be used for fabric 12 if desired.

Figure 3:
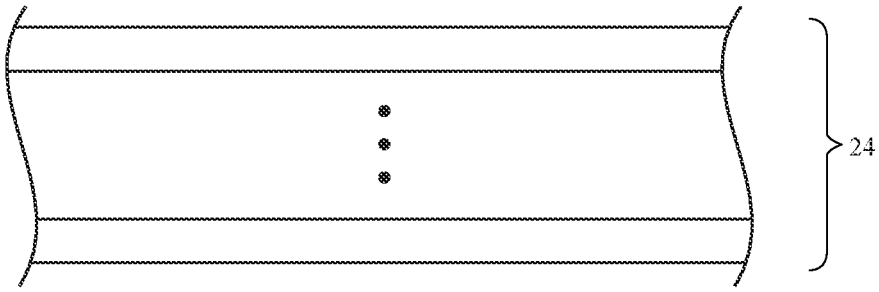
FIG. 3 is a side view of layers of material that may be incorporated into a fabric item in accordance with an embodiment.

Item 10 may include non-fabric materials (e.g., structures formed from plastic, metal, glass, ceramic, crystalline materials such as sapphire, etc.). These materials may be formed using molding operations, extrusion, machining, laser processing, and other fabrication techniques. In some configurations, some or all of item 10 may include one or more layers of material such as layers 24 of FIG. 3. Layers 24 may include layers of polymer, metal, glass, fabric, adhesive, crystalline materials, ceramic, substrates on which components have been mounted, patterned layers of material, layers of material containing patterned metal traces, thin-film devices such as transistors, and/or other layers.

Figure 4:
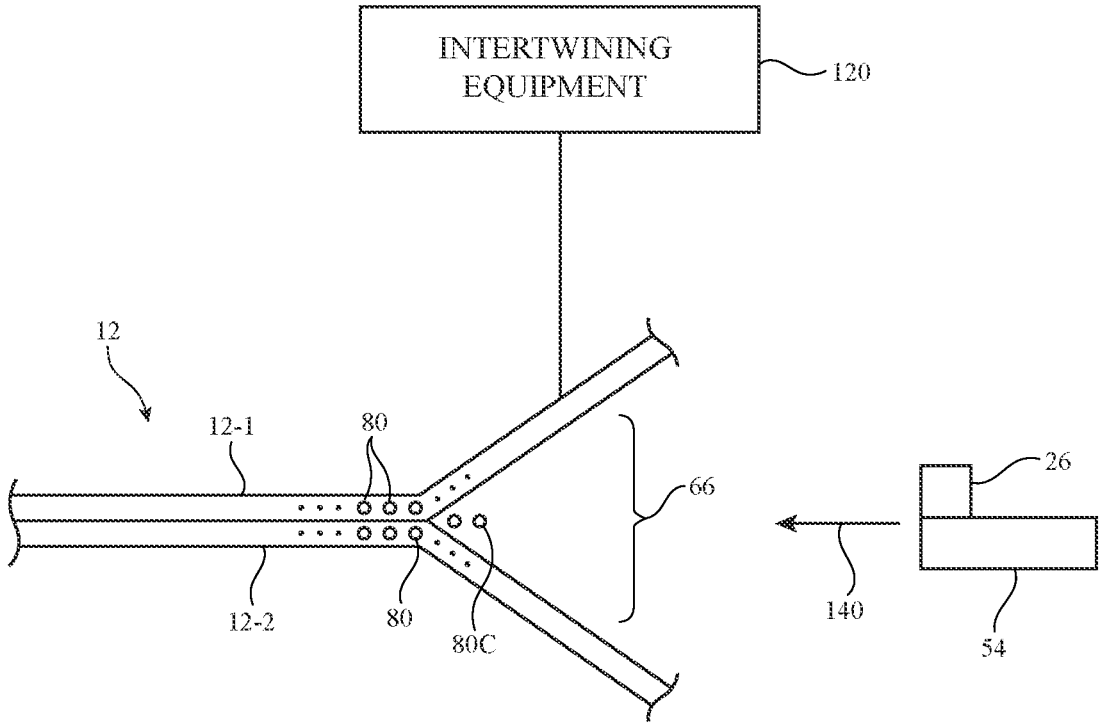
FIG. 4 is a diagram illustrating how interlacing equipment may be used to create fabric while an insertion tool is used to insert one or more electrical components into the fabric in accordance with an embodiment.

A diagram illustrating how electrical components may be inserted into fabric 12 during the formation of fabric 12 is illustrated in FIG. 4. As shown in FIG. 4, fabric 12 may be formed from fabric portions such as fabric portions 12-1 and 12-2. Fabric portions 12-1 and 12-2 may be formed from interlaced strands 80. For example, a first set of strands 80 may be used to form fabric portion 12-1 and a second set of strands 80 may be used to form fabric portion 12-2. Fabric portions 12-1 and 12-2 may be different portions of a single layer of fabric 12, or fabric portion 12-1 may form one or more first layers of fabric 12 and fabric portion 12-2 may form one or more second layers of fabric 12.

Using interlacing equipment 120, strands 80 may be interlaced to form fabric 12. Interlacing equipment 120 may be weaving equipment, knitting equipment, braiding equipment, or other suitable interlacing equipment. Interlacing equipment 120 may be used to create one or more regions in fabric 12 such as pocket 66 (sometimes referred to as a gap, space, cavity, void, position, location, etc.) for receiving electrical components. Regions in fabric 12 that receive electrical components such as pocket 66 may be formed by creating a space or gap between portions of fabric 12 such as fabric portion 12-1 and fabric portion 12-2. The term "pocket" may be used to refer to a void between fabric portions and/or may be used to refer to a position or location between fabric portions (e.g., a position between strands of material in fabric 12, with or without an actual void).

Electrical components may be inserted into pocket 66 during the formation of fabric 12 using component insertion equipment such as insertion tool 54. Insertion tool 54 may hold component 26 and may position component 26 in pocket 66 during interlacing operations (e.g., by moving component 26 towards pocket 66 in direction 140). If desired, component 26 may be electrically and/or mechanically connected to one or more conductive strands 80C in pocket 66. Following insertion and attachment of component 26, interlacing equipment 120 may continue interlacing operations (which may include closing pocket 66, if desired) to continue forming fabric 12.

In some arrangements, processing steps such as alignment of component 26 with conductive strands 80C, electrically connecting (e.g., soldering) component 26 to conductive strands 80C, encapsulation of the electrical connection between component 26 and conductive strands 80C, and/or verification of the integrity of the electrical connection between component 26 and conductive strands 80C may be performed after component 26 is inserted into pocket 66.

In some arrangements, the gap between first and second fabric portions 12-1 and 12-2 may remain in place after electrical component 26 is enclosed in fabric 12 (e.g., a space may exist between fabric portions 12-1 and 12-2 after formation of fabric 12 is complete). In other arrangements, first and second fabric portions 12-1 and 12-2 may be pulled together such that gap 66 is eliminated after electrical component 26 is enclosed in the gap (e.g., fabric portions 12-1 and 12-2 may be in contact with one another without an intervening gap after the formation of fabric 12 is complete). Fabric 12 may have a bulge where electrical component 26 is located, or fabric 12 may not have a bulge where electrical component 26 is located (e.g., the fabric may have substantially uniform thickness across locations with electrical components 26 and locations without electrical components 26, if desired).

Figure 5:
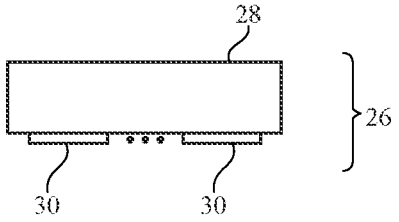
FIG. 5 is a cross-sectional side view of an illustrative electrical component in accordance with an embodiment.

A side view of an illustrative electrical component of the type that may be used in item 10 is shown in FIG. 5. Electrical components in item 10 such as illustrative electrical component 26 of FIG. 5 may include discrete electrical components such as resistors, capacitors, and inductors, may include connectors, may include batteries, may include input-output devices such as switches, buttons, light-emitting components such as light-emitting diodes, audio components such as microphones and speakers, vibrators (e.g., piezoelectric actuators that can vibrate), solenoids, electromechanical actuators, motors, and other electromechanical devices, microelectromechanical systems (MEMs) devices, pressure sensors, light detectors, proximity sensors (light-based proximity sensors, capacitive proximity sensors, etc.), force sensors (e.g., piezoelectric force sensors), strain gauges, moisture sensors, temperature sensors, accelerometers, gyroscopes, compasses, magnetic sensors (e.g., Hall effect sensors and magnetoresistance sensors such as giant magnetoresistance sensors), touch sensors, and other sensors, components that form displays, touch sensor arrays (e.g., arrays of capacitive touch sensor electrodes to form a touch sensor that detects touch events in two dimensions), and other input-output devices, energy storage devices, electrical components that form control circuitry such as non-volatile and volatile memory, microprocessors, application-specific integrated circuits, system-on-chip devices, baseband processors, wired and wireless communications circuitry, and other integrated circuits.

Electrical components such as component 26 may be bare semiconductor dies (e.g., laser dies, light-emitting diode dies, integrated circuits, etc.) or packaged components (e.g. semiconductor dies or other devices packaged within plastic packages, ceramic packages, or other packaging structures). One or more electrical terminals such as contact pads 30 may be formed on body 28 of component 26. Body 28 (sometimes referred to as device 28, electrical device 28, etc.) may be a semiconductor die (e.g., a laser die, light-emitting diode die, integrated circuit, etc.) or may be a package for a component (e.g., a plastic package or other dielectric package that contains one or more semiconductor dies or other electrical devices). Contacts for body 28 such as pads 30 may be protruding leads, may be planar contacts, may be formed in an array, may be formed on any suitable surfaces of body 28, or may be any other suitable contacts for forming electrical connections to component 26. For example, pads 30 may be metal solder pads.

Figure 6:
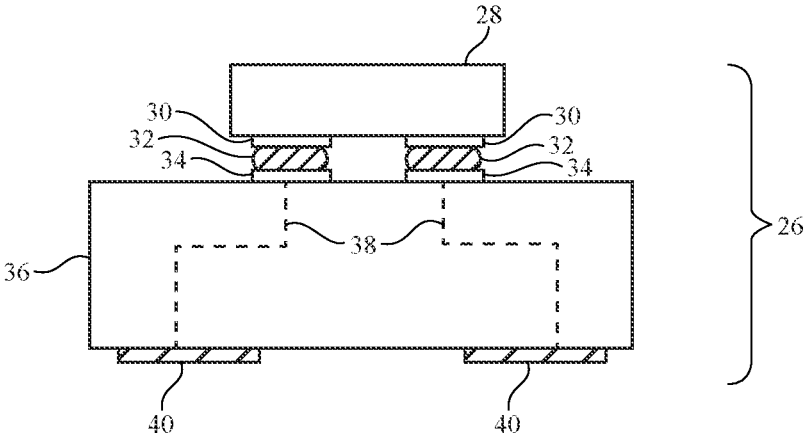
FIG. 6 is a cross-sectional side view of an illustrative electrical component having an electrical device mounted on an interconnect substrate in accordance with an embodiment.

As shown in the example of FIG. 6, body 28 may be mounted on a support structure such as substrate 36. Interposer 36 (sometimes referred to as an interconnect substrate, a printed circuit substrate, etc.) may be a printed circuit, ceramic carrier, or other substrate. The layer(s) forming interconnect substrate 36 may include one or more flexible printed circuit layers such as polyimide layers, one or more layers of rigid printed circuit board material such as fiberglass-filled epoxy (e.g., FR4), and/or layers of other materials (e.g., other dielectric materials such as silicone, other elastomeric material, other flexible polymers, etc.). Interconnect substrate 36 may be larger than body 28 or may have other suitable sizes. Interconnect substrate 36 may have a planar shape with a thickness of 700 microns, more than 500 microns, less than 500 microns, or other suitable thickness. The thickness of body 28 may be 500 microns, more than 300 microns, less than 1000 microns, or other suitable thickness. The footprint (area viewed from above) of body 28 and substrate 36 may be 10 microns×10 microns, 100 microns×100 microns, more than 1 mm×1 mm, less than 10 mm×10 mm, may be rectangular, may be square, may have L-shapes, or may have other suitable shapes and sizes.

Interconnect substrate 36 may contain signal paths such as metal traces 38. Metal traces 38 (sometimes referred to as interconnects, signal paths, etc.) may have portions forming contacts such as pads 34 and 40. Pads 34 and 40 may be formed on the upper surface of interconnect substrate 36, on the lower surface of interconnect substrate 36, and/or on the sides of interconnect substrate 36. Conductive material such as conductive material 32 may be used in mounting body 28 to interconnect substrate 36. Conductive material 32 may be solder (e.g., low temperature solder, high temperature solder, etc.), may be conductive adhesive (isotropic conductive adhesive or anisotropic conductive film), may be formed during welding, and/or may be other conductive material for coupling electrical device pads (body pads) such as pads 30 on body 28 to interconnect substrate pads 34. Metal traces 38 in substrate 36 may couple pads 34 to other pads such as pads 40. If desired, pads 40 may be larger and/or more widely spaced than pads 34, thereby facilitating attachment of substrate 36 to conductive yarns and/or other conductive paths in item 10. Solder, conductive adhesive, or other conductive connections may be used in coupling pads 40 to conductive strands, printed circuit traces, or other conductive path materials in item 10.

Figure 7:
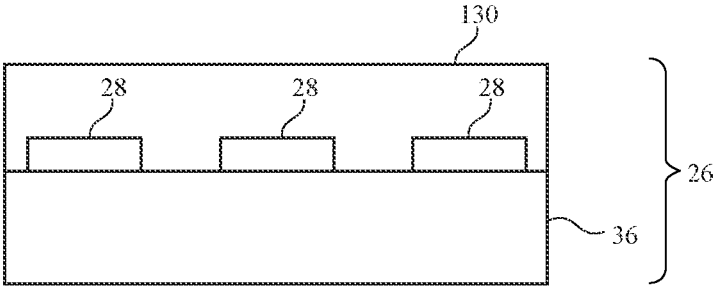
FIG. 7 is a cross-sectional side view of an illustrative electrical component having a protective structure in accordance with an embodiment.

FIG. 7 shows an example in which component 26 includes a protective structure such as protective structure 130 on interconnect substrate 36. Protective structure 130 may, for example, be a plastic structure that completely or partially encapsulates devices 28 and interconnect substrate 36 to provide mechanical robustness, protection from moisture and other environmental contaminants, heat sinking, and/or electrical insulation. Protective structure 130 may be formed from molded plastic (e.g., injection-molded plastic, insert molded plastic, transfer molded plastic, low-pressure molded plastic, two-part molded plastic, etc.) that has been molded over one or more devices 28 and substrate 36 or that is molded into the desired shape and subsequently attached to substrate 36, may be a layer of encapsulant material (e.g., thermoplastic) that has been melted to encapsulate devices 28, may be a layer of polymer such as polyimide that has been cut or machined into the desired shape and subsequently attached to substrate 36, or may be formed using other suitable methods. Illustrative materials that may be used to form protective structure 130 include epoxy, polyamide, polyurethane, silicone, thermoplastic, other suitable materials, or a combination of any two or more of these materials. Protective structure 130 may be formed on one or both sides of substrate 36 (e.g., may completely or partially surround substrate 36).

Protective structure 130 may be entirely opaque, may be entirely transparent, or may have both opaque and transparent regions. Transparent portions of protective structure 130 may allow light emitted from one or more devices 28 to be transmitted through protective structure 130 and/or may allow external light to reach (and be detected by) one or more devices 28. If desired, one or more openings, recesses, grooves, and/or other features may be formed in protective structure 130. For example, an opening may be formed in protective structure 130 to allow light to be detected by and/or emitted from one or more devices 28. Protective structure 130 may include one or more grooves for receiving strands (e.g., conductive or insulating strands) in fabric 12.

Protective structure 130 may, if desired, have different thicknesses. The example of FIG. 7 in which protective structure 130 has uniform thickness across substrate 36 is merely illustrative. In some arrangements, protective structure 130 may be an encapsulant material such as thermoplastic that has been melted to create a robust connection between component 26 and strands 80 of fabric 12. For example, protective structure 130 may surround portions of strands 80, may fill recesses, grooves, or other features in component 26 to help interlock component 26 to strands 80, and/or may fill gaps in fabric 12. Protective structure 130 may include one or more different types of materials, if desired (e.g., one or more different thermoplastic materials with different melting temperatures).

If desired, substrate 36 may be sufficiently large to accommodate multiple electrical devices each with a respective body 28. For example, one or more light-emitting diodes, sensors, microprocessors, and/or other electrical devices may be mounted to a common substrate such as substrate 36 of FIG. 7. The light-emitting diodes may be micro-light-emitting diodes (e.g., light-emitting diode semiconductor dies having footprints of about 10 microns×10 microns, more than 5 microns×5 microns, less than 100 microns×100 microns, or other suitable sizes). The light-emitting diodes may include light-emitting diodes of different colors (e.g., red, green, blue, white, etc.), infrared light, or ultraviolet light. Redundant light-emitting diodes or other redundant circuitry may be included on substrate 36. In configurations of the type shown in FIG. 7 in which multiple electrical devices (each with a respective body 28) are mounted on a common substrate, electrical component 26 may include any suitable combination of electrical devices (e.g., light-emitting diodes, sensors, integrated circuits, actuators, energy storage devices, and/or other devices of the type described in connection with electrical component 26 of FIG. 5).

The examples of FIGS. 6 and 7 in which devices 28 are only located on one side of substrate 36 are merely illustrative. If desired, devices 28 may be mounted to both sides of substrate 36.

Electrical components 26 may be coupled to fabric structures, individual strands, printed circuits (e.g., rigid printed circuits formed from fiberglass-filled epoxy or other rigid printed circuit board material or flexible printed circuits formed from polyimide substrate layers or other sheets of flexible polymer materials), metal or plastic parts with signal traces, or other structures in item 10.

Figure 8:
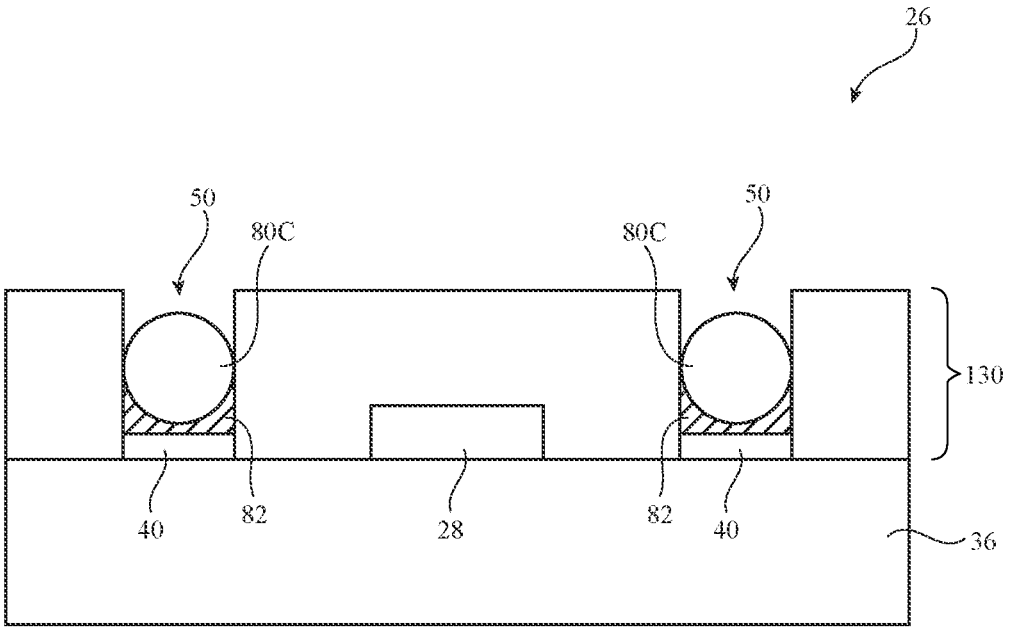
FIG. 8 is a cross-sectional side view of an illustrative electrical component having recesses for receiving strands in accordance with an embodiment.

In some configurations, item 10 may include electrical connections between components 26 and conductive paths in fabric 12. As shown in FIG. 8, for example, component 26 may be coupled to conductive strands 80C of fabric 12. Conductive strands 80C (sometimes referred to as "wires") may be configured to carry electrical signals (e.g., power, digital signals, analog signals, sensor signals, control signals, data signals, input signals, output signals, or other suitable electrical current) to and/or from components 26. Strands 80C may be warp strands (e.g., warp strands 20 of FIG. 2), weft strands (e.g., weft strands 22 of FIG. 2), or other suitable strands 80 in fabric 12. If desired, component 26 may be coupled to only a single conductive strand 80C, may be coupled to two conductive strands 80C, or may be coupled to three or more conductive strands 80C. If desired, component 26 may also or instead be coupled to insulating strands in fabric 12. Arrangements in which component 26 is coupled to a pair of conductive strands 80C are sometimes described herein as an illustrative example.

Component 26 may have contact pads such as pads 40. Conductive material 82 may be used to couple pads 40 to conductive strands 80C. Conductive material 82 may be solder, anisotropic conductive adhesive, or other conductive material. Arrangements in which conductive material 82 is formed from solder may sometimes be described herein as an illustrative example. In the example of FIG. 8, pads 40 are formed on the same surface of substrate 36 on which device 28 is mounted. Conductive material 82 may be used to electrically and mechanically couple component 26 to strands 80C of fabric 12. If desired, pads 40 may also or instead be additionally formed on the lower surface of substrate 36 (e.g., the surface opposite the surface on which device 28 is mounted). The example of FIG. 8 is merely illustrative.

In some configurations, it may be desirable to provide a more robust mechanical connection between component 26 and fabric 12 to ensure that component 26 does not come loose when fabric 12 is bent or stretched. To increase the robustness of the connection between strands 80C and component 26, component 26 may have one or more recesses for receiving strands 80C. For example, one or more strands 80 may be threaded through a portion of component 26 to help secure component 26 to fabric 12. Strands 80 may be threaded through openings (sometimes referred to as recesses, trenches, grooves, holes, slots, notches, etc.) of component 26. The openings may be formed in device 28, interconnect substrate 36, protective structure 130, and/or other portions of component 26. FIG. 8 shows an example in which conductive strands 80C are received within grooves such as grooves 50 that are formed in protective structure 130. This is, however, merely illustrative. If desired, grooves 50 may instead or additionally be formed in interconnect substrate 36, device 28, and/or other portions of component 26. The location, shape, and geometry of grooves 50 of FIG. 8 are merely illustrative.

Grooves 50 (sometimes referred to as recesses, trenches, openings, holes, slots, notches, etc.) in protective structure 130 may be formed by removing portions of protective structure 130 (e.g., using a laser, a mechanical saw, a mechanical mill, or other equipment) or may be formed by molding (e.g., injection molding, insert molding, etc.) or otherwise forming protective structure 130 into a shape that includes grooves 50. Grooves 50 may have a width between 2 mm and 6 mm, between 0.3 mm and 1.5 mm, between 1 mm and 5 mm, between 3 mm and 8 mm, greater than 3 mm, less than 3 mm, or other suitable width. If desired, grooves 50 may have different depths (e.g., to expose contact pads 40 that are located at different surface heights of interconnect substrate 36).

In the example of FIG. 8, grooves 50 expose conductive pads 40 on interconnect substrate 36. Strands 80C may each be threaded through an associated one of grooves 50 in protective structure 130. Solder or other conductive material 82 may be used to electrically and mechanically couple strands 80C to conductive pads 40 in grooves 50 of protective cover 130. Because strands 80C are wedged between portions of protective cover 130, strands 80C may be resistant to becoming dislodged from substrate 36. In addition to holding strands 80C in place so that component 26 remains attached to fabric 12, grooves 50 may also be used as a physical guide for aligning component 26 relative to fabric 12 during component insertion and attachment operations. This may be beneficial when inserting and attaching component 26 to fabric 12 without line of sight, for example.

Each strand 80C may align with an associated pad 40 on component 26. If desired, pads 40 may formed from elongated strips of conductive material (e.g., metal) that extend from one edge of substrate 36 to an opposing edge of substrate 36. This provides a large area with which to form a mechanical and electrical connection between substrate 36 and strands 80C. The elongated shape of pads 40 may allow conductive material 82 to attach a longer portion of strand 80C to pad 40. The connection between pad 40 and strand 80C may, for example, span across the width of substrate 36, thereby providing a robust connection between substrate 36 and strand 80C. This is, however, merely illustrative. If desired, pads 40, conductive material 82, and the exposed conductive portions of strands 80C may span across less than all of the width of component 26.

One or more electrical components such as electrical component 26 may be incorporated into a fabric seam or hem. The fabric seam may join two or more portions of fabric, may join fabric with a non-fabric material (e.g., leather, metal, plastic, etc.), and/or may form an outer edge (e.g., a border) of a fabric item. If desired, fabric seams that incorporate electrical components may be manufactured as stand-alone items that can later be incorporated into clothing items to provide the clothing items with a desired set of electrical functions (e.g., sensing, visual output, fitness tracking, location tracking, heartrate tracking, display functionality, etc.).

Figure 9:
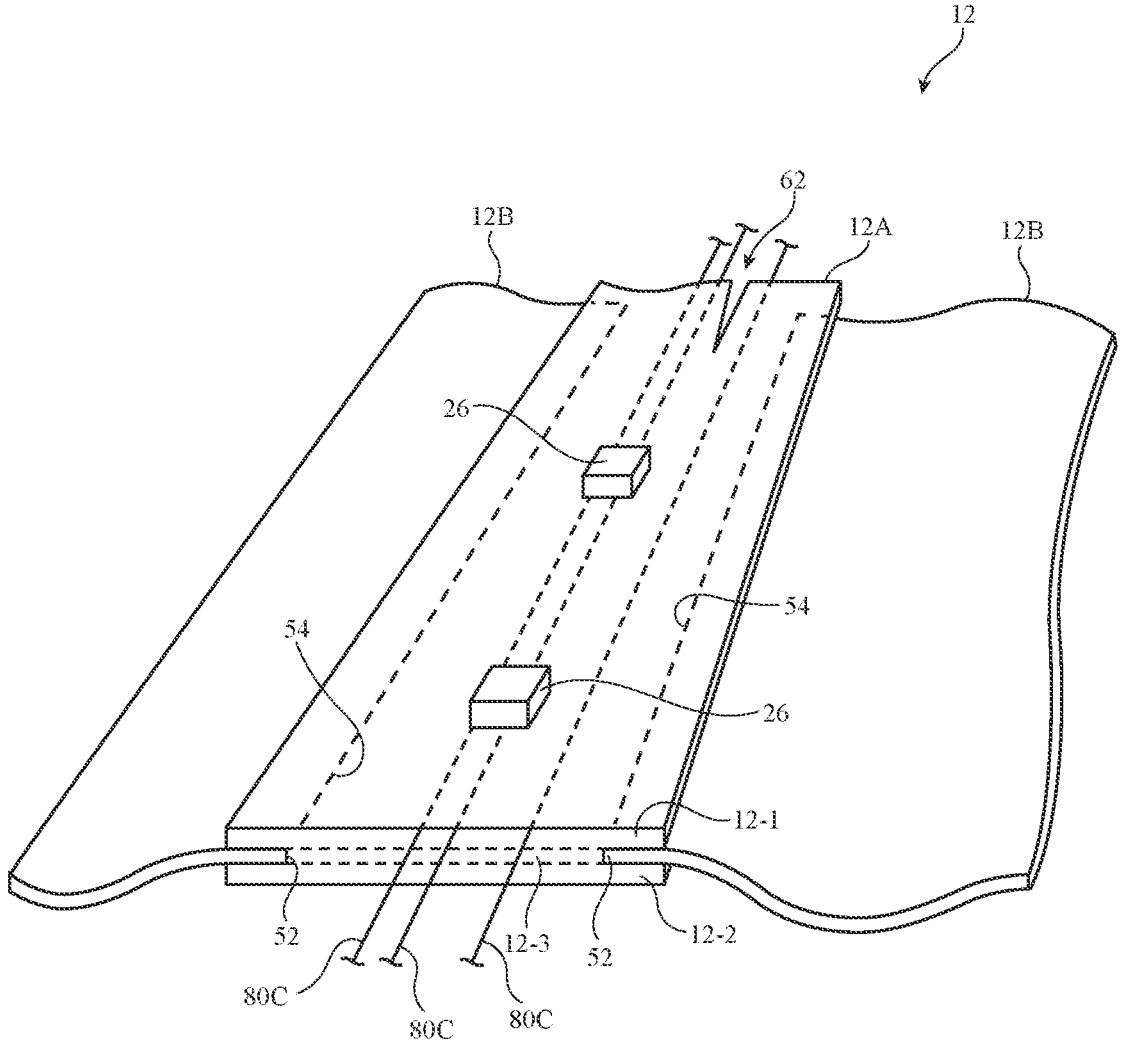
FIG. 9 is a perspective view of an illustrative fabric item having a seam with integrated electrical components in accordance with an embodiment.

FIG. 9 is a perspective view of an illustrative fabric seam. In the example of FIG. 9, fabric seam 12A is coupled between first and second fabric portions 12B. This is merely illustrative, however. If desired, seam 12A may only be coupled to one fabric portion 12B (e.g., in arrangements where seam 12A is located along the border of a fabric item such as a collar, a hem of a shirt, dress, pair of pants, etc.), may be coupled to one fabric portion 12B and one non-fabric portion (e.g., a piece of leather, plastic, metal, etc.), and/or may be a standalone item without fabric portions 12B or other material on either side. In general, seam 12A may be any suitable type of seam (e.g., any type of stitching) such as an exposed seam, an enclosed seam, a curved seam, a straight seam, a hem, a plain seam, a hairline seam, a lapped seam, a French seam, a seam at the border of a piece of fabric, etc.

As shown in FIG. 9, electrical components 26 may be incorporated into seam 12A. There may be one, two, three, four, ten, twenty, more than twenty, or less than twenty electrical components 26 incorporated into a given seam 12A. Electrical components 26 may be incorporated into fabric seam 12A during the formation of fabric seam 12A (e.g., as described in connection with FIGS. 1-8), or may be incorporated into fabric seam 12A after seam 12A is formed.

If desired, electrical components 26 may be configured for health-related functions such as fitness tracking, activity tracking, medical applications, biometric applications, wellness applications, personal training, rehabilitation, stress relief, focus, full-body motion tracking, physical therapy, sun exposure monitoring, fall detection, posture monitoring, and/or other suitable health-related functions, may include wireless payment circuitry for making contactless payments, and/or may include one or more sensors, haptic output devices, light sources such as status indicators and/or displays, wireless power receiving circuitry, and/or communications circuitry for communicating with an electronic device.

Electrical components 26 may include one or more sensors that are used in gathering health-related measurements and/or user input and may include light sensors (visible light sensors, color sensitive light sensors, ultraviolet light sensors, etc.), optical proximity sensors, capacitive proximity sensors, temperature sensors, force sensors (e.g., strain gauges, capacitive force sensors, resistive force sensors, force sensors for measuring biometric information, etc.), microphones for sensing audio and/or ultrasonic signals, magnetic sensors (e.g., Hall effect sensors, giant magnetoresistance sensors, or other sensors or magnetometers that measure magnetic fields), gas pressure sensors, heart rate sensors, blood oxygen level sensors (e.g., based on emitted and detected light), electrocardiogram sensors (e.g., sensors for measuring electrical signals on a user's body), humidity sensors, moisture sensors, particulate sensors (e.g., sensors that use light measurements and/or other measurements to measure particulate concentration in the air), image sensors (cameras), gas pressure sensors, carbon dioxide sensors and/or sensors measuring other gas concentrations, motion sensors for detecting position, orientation, and/or movement (e.g., accelerometers, magnetic sensors such as compass sensors, gyroscopes, barometers, and/or inertial measurement units that contain some or all of these sensors), radio-frequency sensors, depth sensors (e.g., structured infrared light sensors and/or depth sensors based on stereo imaging devices), optical sensors such as self-mixing sensors and light detection and ranging (lidar) sensors that gather time-of-flight measurements, accelerometers for gathering user tap input (e.g., single taps, double taps, triple taps, etc.), and/or other sensors.

Fabric seam 12A may have multiple portions such as fabric portion 12-1, fabric portion 12-2, and portion 12-3. As described in connection with FIG. 4, fabric portions 12-1 and 12-2 may be formed from interlaced strands 80. Fabric portions 12-1 and 12-2 may be different portions of a single layer of fabric 12, or fabric portion 12-1 may form one or more first layers of fabric 12 and fabric portion 12-2 may form one or more second layers of fabric 12. Portion 12-3 of fabric seam 12A may be a single layer of fabric between portions 12-1 and 12-2, may be a spacer fabric between portions 12-1 and 12-2 (e.g., portion 12-3 may be a spacer fabric having inner and outer warp knit layers that are joined by a spacer layer such as one or more monofilaments or other spacer strands that are coupled between the inner and outer warp knit layers), may be a spacer layer such as one or more monofilaments that are coupled between fabric portions 12-1 and 12-2, and/or may be a gap between fabric portions 12-1 and 12-2 (e.g., a gap similar to pocket 66 of FIG. 4). If desired, portion 12-3 may be omitted and fabric portion 12-1 may be coupled directly to fabric portion 12-2.

Electrical components 26 may be coupled to conductive strands 80C in fabric seam 12A. For example, each component 26 may have one or more grooves 50 (as shown in FIG. 8) that each receives an associated conductive strand 80C. Conductive strand 80C may be soldered or otherwise mechanically and/or electrically coupled to a contact pad on component 26. If desired, the electrical connections between strands 80C component 26 may be encapsulated with thermoplastic material (e.g., protective structure 130) or other encapsulation material.

In arrangements where there are multiple electrical components 26 incorporated into fabric seam 12A, each electrical component 26 may be coupled to a different conductive strand 80C, or some electrical components 26 may be coupled to one or more of the same strands 80C. Electrical components 26 that are coupled to the same conductive strands 80C may be isolated from one another (e.g., may be separated by one or more insulating segments of strands 80C) and/or may be electrically coupled to one another (e.g., one component 26 may transmit signals to another component 26 via conductive strands 80C). If desired, components 26 and strands 80C may form an interconnected network of sensors, input devices, and/or output devices within a given fabric item (e.g., a shirt, a pair of pants, a dress, a wristband, a headband, other wearable fabric items, non-wearable fabric items such as bags, vehicle interiors, etc., and/or any other suitable fabric item).

As shown in FIG. 9, seam 12A may have one or more gaps such as gap 62 that allows portions of fabric seam 12A to branch off from one another. This allows the electrical pathways within seam 12A (e.g., electrical pathways formed from strands 80C) to split off in different directions (e.g., to reach other portions of the fabric item, to connect with other conductive strands 80C in the fabric item and/or in other seams 12A in the fabric item, to accommodate bends or curves in the fabric item, etc.). Gap 62 may extend through some or all of the thickness of seam 12A (e.g., through some or all of portions 12-1, 12-2, and 12-3).

Fabric seam 12A may have one or more side pockets such as side pockets 52 for receiving ends 54 of fabric portions 12B. In the example of FIG. 9, seam 12A has a first side pocket 52 for receiving end 54 of a first fabric portion 12B and a second side pocket 52 for receiving end 54 of a second fabric portion 12B. Openings 52 (sometimes referred to as outer pockets, openings, cavities, gaps, U-shaped openings, grooves, trenches, etc.) may be side-facing pockets that extend along some or all of the length of seam 12A. Side pockets 52 may be formed during the formation of fabric 12 or may be created after fabric 12 is formed (e.g., by removing stitching that couples upper fabric portion 12-1 to lower fabric portion 12-2). Ends 54 of fabric portions 12B may be coupled to seam 12A within side pockets 52 via stitching, adhesive, fusible material (e.g., fusible strands 80 that are interlaced with portion 12B, portion 12-1, portion 12-2, and/or portion 12-3 and that are melted to attach ends 54 to seam 12A), welding, and/or any other suitable attachment technique.

Figure 10:
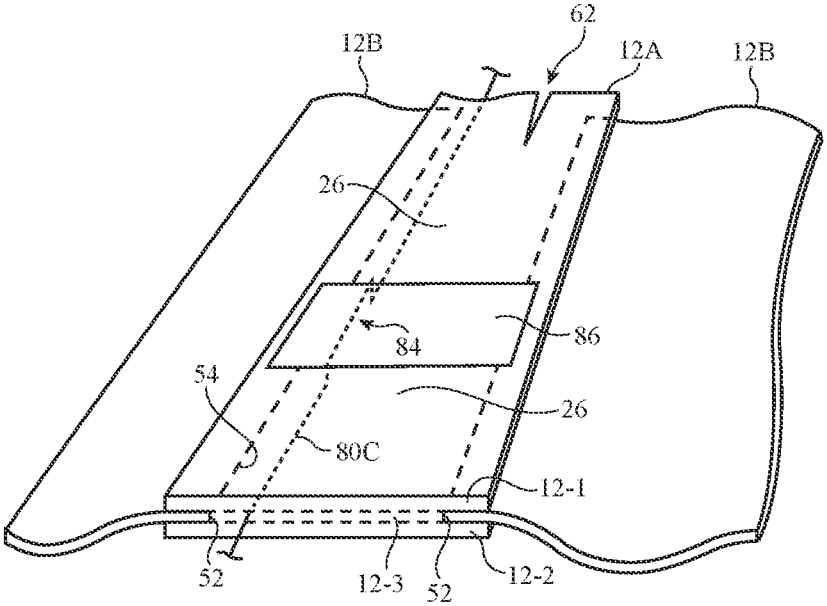
FIG. 10 is a perspective view of an illustrative fabric item having a seam with one or more integrated electrodes in accordance with an embodiment.
Figure 11:
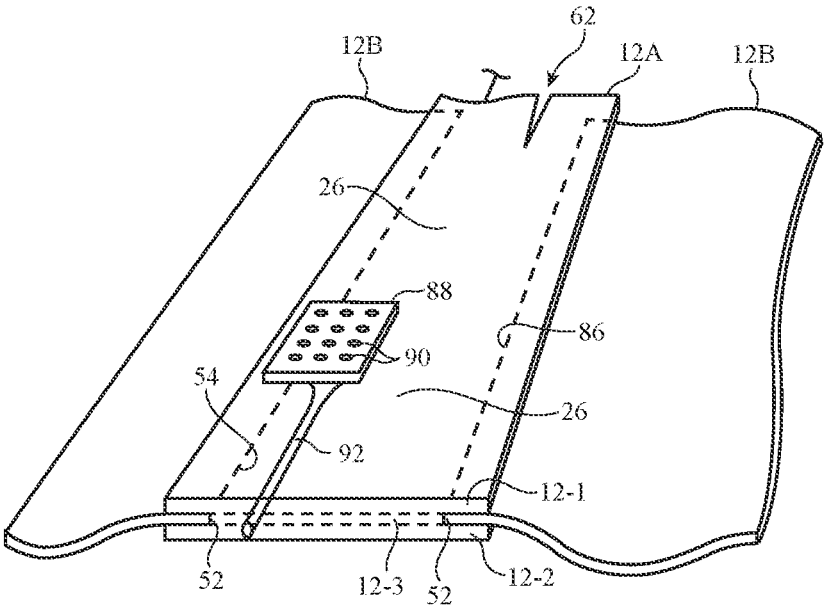
FIG. 11 is a perspective view of an illustrative fabric item having a seam with one or more integrated tubes in accordance with an embodiment.

FIG. 10 shows how seam 12A may incorporate one or more electrodes such as electrode 86. Electrode 86 may be a sheet of conductive material such as metal or indium tin oxide, or electrode 86 may be formed from a patch of conductive strands 80C in fabric seam 12A. Electrode 86 may be located between upper and lower fabric portions 12-1 and 12-2, or electrode 86 may be formed on an exposed outer surface of seam 12A. If desired, conductive strands 80C may include portions that overlap electrode 86 such as segment 84. If desired, segment 84 of strand 80C and electrode 86 may be separated by a gap and may form a capacitor (e.g., a capacitive touch sensor electrode that forms an input device such as a capacitive button and/or a capacitive touch sensor electrode that forms part of an array of capacitive touch sensing electrodes to form a touch-sensitive region in fabric seam 12A).

Figure 12:
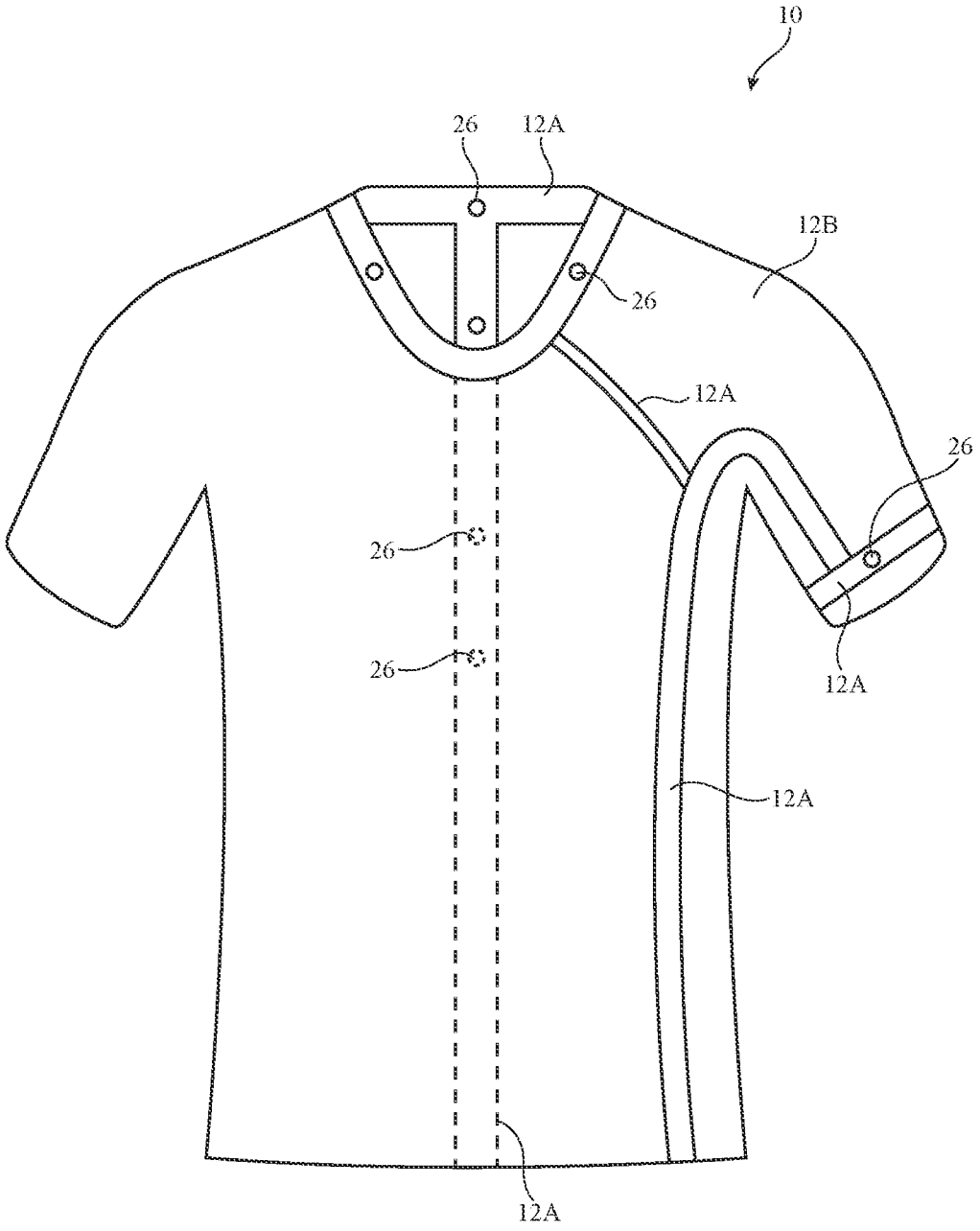
FIG. 12 is a front view of an illustrative fabric item having a seam with one or more integrated electrical components in accordance with an embodiment.

FIG. 12 shows how seam 12A may incorporate one or more tubes such as tube 92. Tube 92 may be coupled to an end piece such as planar member 88. Planar member 88 may have one or more openings such as openings 90 that are exposed to the exterior of fabric seam 12A. Tube 92 may be used to deliver fluids and/or gases to planar member 88 so that the fluids or gases can exit seam 12A via openings 90. This type of arrangement may be useful for providing cooling and/or heating effects (e.g., control circuitry 16 may provide cooling air to a user via tube 92 and openings 90). If desired, tube 92 may instead or additionally be used to receive fluids and/or gases through openings 90 and may deliver the fluids and/or gases elsewhere in fabric seam 12A.

FIG. 12 is a front view of an illustrative item 10 that incorporates a fabric seam with integrated electrical components. In the example of FIG. 12, item 10 is a piece of clothing such as a shirt. The shirt may have fabric portions 12B coupled together using seams 12A. For example, one seam 12A may form a collar that fits around a user's neck, another seam 12A may form a band around a user's arm, another seam 12A may extend down the back of the shirt, another seam 12A may extend down the side of the shirt, etc. The seam locations of FIG. 12 are merely illustrative examples. Electrical components 26 may be incorporated into seams 12A.

Electrical components 26 may have a single, set function that is predetermined during manufacturing (e.g., components 26 may be configured specifically for posture monitoring during manufacturing), a set function that is determined during an initial set up process by the user (e.g., the user may configure components 26 as fitness tracking devices) or by a third party (e.g., a physician for the user), and/or an adjustable function or set of functions that can be freely changed and reconfigured based on the user's needs. For example, the user may configure a device 26 as a fall detection device during regular use and may reconfigure device 26 as a physical therapy assistant during physical therapy sessions.

Electrical components 26 may be placed at locations within item 10 based on the desired functionality of each component 26. For example, electrical component 26 around an arm of shirt 10 may have a heart rate sensor for monitoring heart rate and/or may have a motion sensor (e.g., an accelerometer) for tracking arm movements, electrical component 26 along the back of shirt 10 may have a posture monitoring device and a haptic output device that provides haptic output to remind a user to straighten his or her back when the posture monitoring device indicates that the user's back is slumped. Electrical components 26 around the collar of shirt 10 may include light sensors for monitoring sun exposure levels. These examples are merely illustrative. In general, electrical components 26 may be configured with any set of suitable input-output functions and may be placed at any suitable location in fabric item 10.

As shown in FIG. 12, some seams 12A have bends and curves (e.g., change direction in item 10), some seams 12A branch off into multiple directions (e.g., to connect to other seams 12A), some seams 12A are wider than other seams 12A, some seams 12A have greater or fewer electrical components 26 than other seams 12A, etc. If desired, some seams 12A may have no electrical components 26 but may include conductive strands 80C that form signal paths to other seams 12A that do have electrical components 26. Electrical components 26 may operate as standalone devices that include individual control circuits, may be controlled by control circuitry that is located within item 10, and/or may be controlled by control circuitry that is within an external electronic device (e.g., a user's personal electronic device such as a cellular telephone, laptop, tablet computer, watch, etc.). These examples are merely illustrative. Other configurations for item 10 may be used, if desired.

Figure 13:
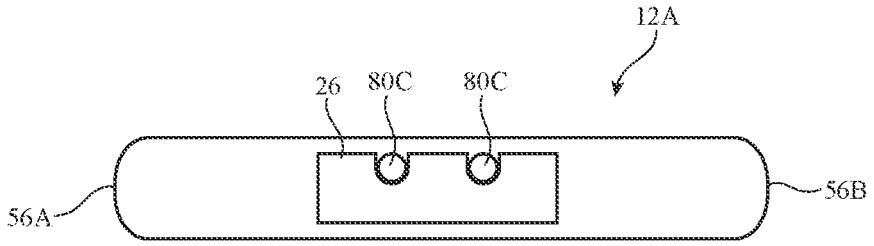
FIG. 13 is a cross-sectional side view of an illustrative fabric seam with opposing edges without side pockets in accordance with an embodiment.
Figure 14:
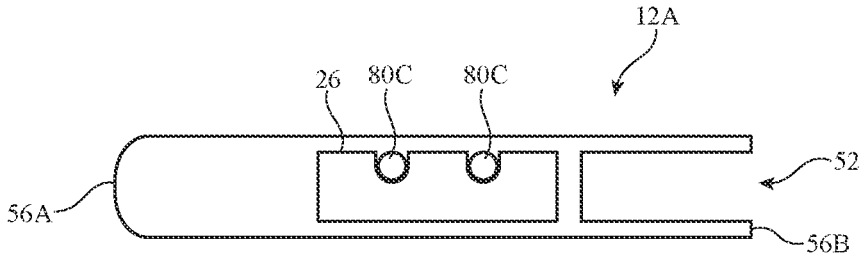
FIG. 14 is a cross-sectional side view of an illustrative fabric seam with a first edge that does not include a side pocket and a second edge that has a side pocket in accordance with an embodiment.
Figure 15:
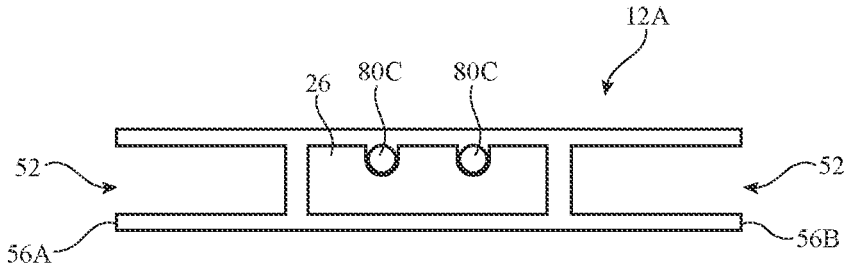
FIG. 15 is a cross-sectional side view of an illustrative fabric seam with first and second side pockets in accordance with an embodiment.

FIGS. 13, 14, and 15 show illustrative examples of edge shapes that may be used for seam 12A. In the example of FIG. 13, seam 12A has first and second opposing edges 56A and 56B that are free of openings (e.g., side pockets 52 of FIG. 9). Edges 56A and 56B may have any suitable side profile (e.g., curved, rectangular, beveled, etc.). Edges 56A and 56B may have the same side profile or may have different side profiles. Since there are no side pockets 52, other fabric portions such as fabric portions 12B may be stitched or otherwise attached to an outer portion of seam 12A (e.g., rather than fitting within a side pocket of seam 12A).

In the example of FIG. 14, seam 12A has first and second opposing edges 56A and 56B. One edge such as edge 56A may be free of openings (e.g., may not have a side pocket 52), whereas the other edge such as edge 56B may have side pocket 52 for receiving material such as fabric portion 12B.

In the example of FIG. 15, seam 12A has first and second opposing edges 56A, both having an associated side pocket 52 for receiving material such as fabric portions 12B.

Figure 16:
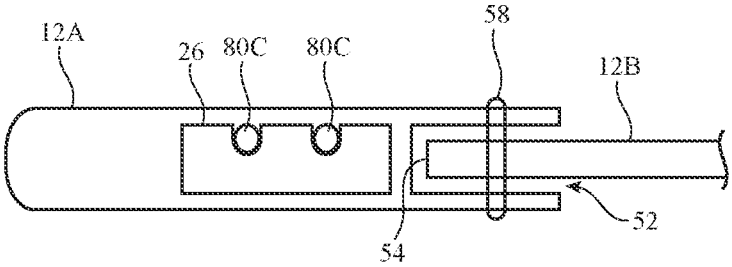
FIG. 16 is a cross-sectional side view of an illustrative fabric seam that is coupled to a piece of material using a stitch in accordance with an embodiment.
Figure 17:
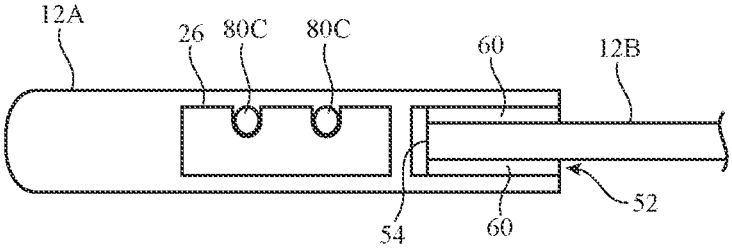
FIG. 17 is a cross-sectional side view of an illustrative fabric seam that is coupled to a piece of material using an attachment structure in accordance with an embodiment.
Figure 18:
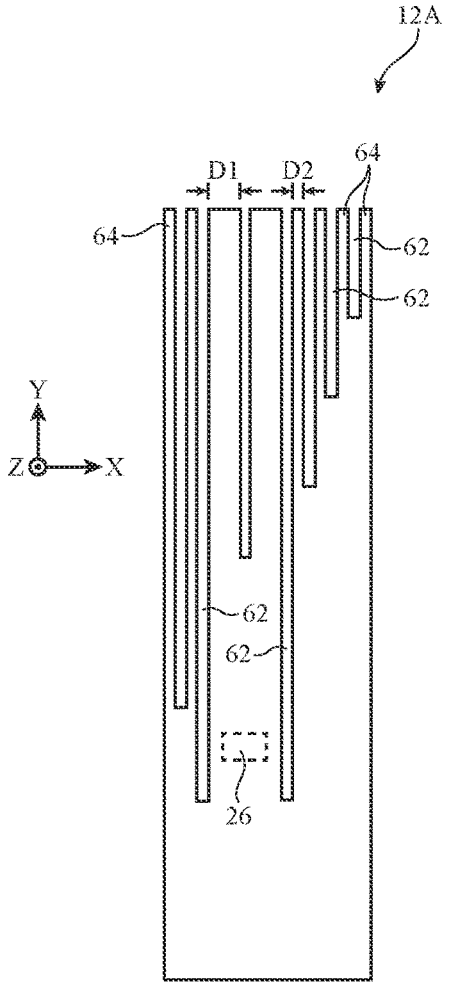
FIG. 18 is a top view of an illustrative fabric seam having gaps in accordance with an embodiment.

FIGS. 17 and 18 show illustrative examples of attachment techniques for attaching fabric seam 12A to fabric portion 12B. In the example of FIG. 16, fabric portion 12B is received within side pocket 52 and is stitched to fabric seam 12A using stitching 58. Stitching 58 may be formed from strands 80 that are interlaced with strands 80 of fabric seam 12A and strands 80 of fabric portion 12B. Stitch 58 may be any suitable type of stitch (e.g., a chain stitch, a lockstitch, a straight stitch, etc.).

In the example of FIG. 17, fabric portion 12B is received within side pocket 52 and is bonded to fabric seam 12A using structure 60. Structure 60 may be a layer of adhesive, a weld, a set of fusible strands 80 that have been melted to bond seam 12A to fabric 12B, and/or other suitable attachment structure.

Figure 19:
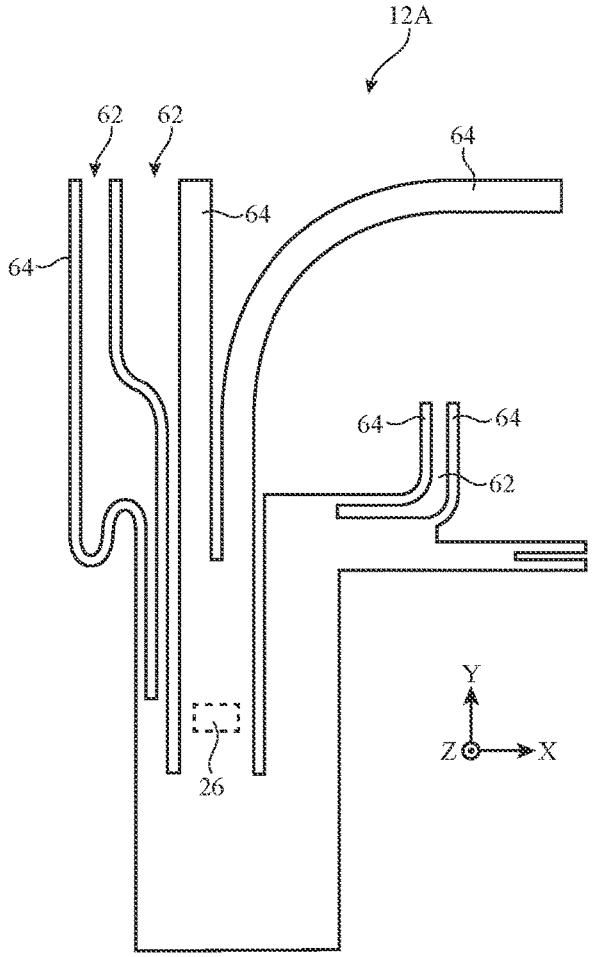
FIG. 19 is a top view of an illustrative fabric seam having gaps between strips that allow the strips to bend in different directions in accordance with an embodiment.

FIGS. 18 and 19 are top views of an illustrative fabric seam 12A having gaps to allow the signal paths within seam 12A to branch out from one another in different directions. FIG. 18 shows how fabric seam 12A may be formed with gaps 62 between seam strips 64. Seam strips 64 may have uniform widths between gaps 62 or may have different widths. For example, one strip 64 may have a width D1 between adjacent gaps 62, while another strip 64 may have a width D2 between adjacent gaps 62, with D2 being less than D1. Gaps 62 may be formed in seam 12A during formation of seam 12A (e.g., a warp knitting machine or other equipment described in connection with FIG. 4 may be used to produce fabric 12A with gaps 62), or gaps 62 may be formed in seam 12A after seam 12A is knitted, woven, or otherwise formed. Each strip 64 may include one conductive strand 80C, may include multiple conductive strands 80C, and/or may be free of conductive strands 80C.

Initially, seam 12A may lie flat. For example, seam 12A may initially lie in a plane (e.g., the X-Y plane of FIG. 16) and strips 64 may extend parallel to an axis (e.g., the Y-axis of FIG. 18). When seam 12A is incorporated into an item such as fabric item 10, strips 64 may be bent in one or more directions, as shown in FIG. 19. Strips 64 may be bent in any suitable direction (e.g., the X, Y, and/or Z direction of FIG. 19) and may be bent any suitable number of times (e.g., a strip 64 may have one, two, three, or more than three turns). Seam 12A and the strips 64 that form part of seam 12A may be sufficiently flexible and/or stretchable to allow signal paths (e.g., strands 80C) within seam 12A to branch out without damaging the signal paths or electrical components 26. This allows signals from electrical components 26 to be routed to different locations within item 10 (e.g., a side seam 12A on shirt 10 may have a first strip 64 that branches off to an arm seam 12A and a second strip 64 that branches off to a collar seam 12A, as in the example of FIG. 12).

As another example, fabric seam 12A may form part of a glove having sensors and/or other electrical components 26 located along the user's individual fingers. Seam 12A may have central base portion at the user's palm (or on the back of the user's hand) and may have different strips 64 that extend from the base portion and branch off to extend along the user's individual fingers. This allows the electrical components 26 along the individual fingers to be connected to one another and/or to common control circuitry with the use of a single fabric seam, if desired.

If desired, one or more portions of seam 12A may form a connector. For example, seam 12A may have a portion with one or more electrical contacts (e.g., exposed portions of conductive strands 80C, metal leads or contact pads that are coupled to strands 80C, etc.) that are configured to mate with electrical contacts of a mating connector (e.g., a connector on another seam 12A in item 10 and/or a connector that is external to item 10).

Figure 20:
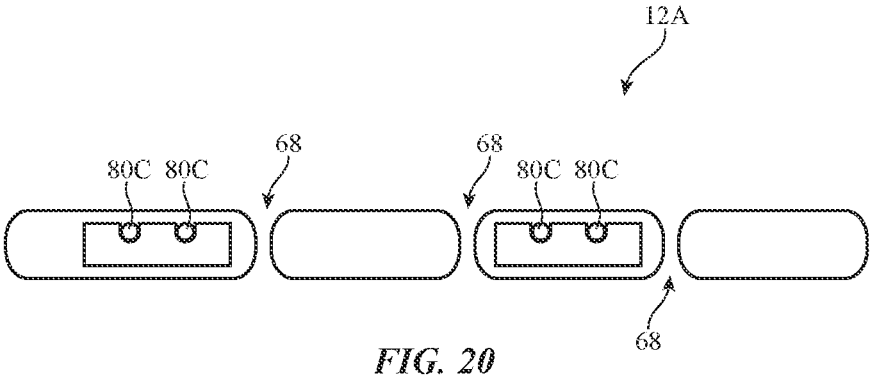
FIG. 20 is a cross-sectional side view of an illustrative fabric seam having one or more openings in accordance with an embodiment.
Figure 21:
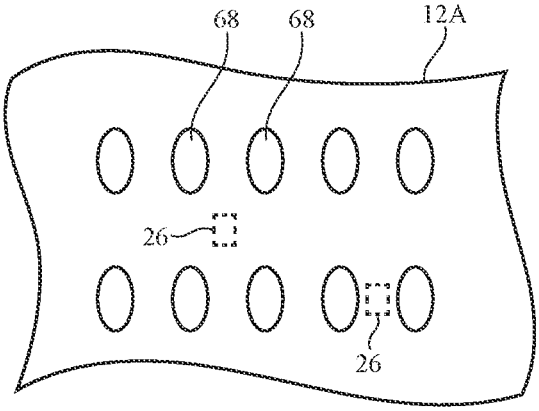
FIG. 21 is a top view of an illustrative fabric seam having an array of openings in accordance with an embodiment.

In some arrangements, openings may be incorporated into fabric seam 12A. As shown in FIG. 20, for example, openings 68 may be incorporated into fabric seam 12A to increase airflow and/or to allow light transmission through fabric seam 12A. There may be a single opening 68 in fabric seam 12A, two openings in fabric seam 12A, and/or an array of openings in fabric seam 12A, as shown in the top view of FIG. 21. Openings 68 may extend fully or partially through the thickness of fabric seam 12A. Openings 68 may be located between electrical components 26 and/or electrical components 26 may be located between openings 68. Openings 68 may be used to increase the breathability of fabric 12 and/or may be configured to allow light or other elements to pass through fabric 12.

Figure 22:
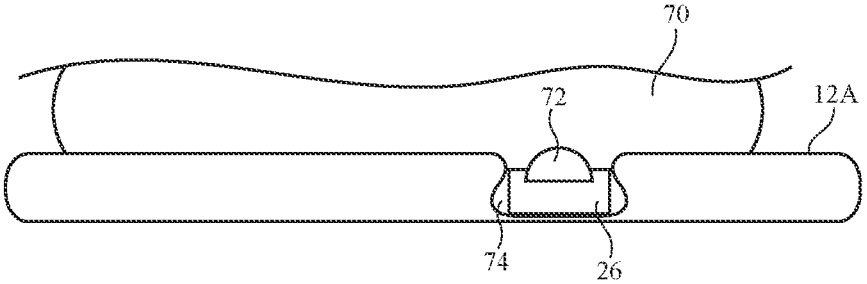
FIG. 22 is a cross-sectional side view of an illustrative fabric seam having a window for an electrical component in accordance with an embodiment.

In the example of FIG. 22, fabric seam 12A includes a window that exposes electrical component 26 to the exterior of seam 12A to allow light, air, and/or other elements to reach component 26 and/or to be emitted from component 26 to the outside. Electrical component 26 may be mounted within opening 74 of fabric seam 12A. Opening 74 may be a pocket (e.g., similar to pocket 66 of FIG. 4) that is created during the formation of fabric seam 12A or may be created in seam 12A after seam 12A is formed. Opening 74 may form a window that allows component 26 to emit signals through opening 74 to the outside and/or to detect signals from the outside through opening 74.

For example, component 26 may include an optical component such as optical component 72. Optical component 72 may be a light sensor, a light-emitting device, a proximity sensor that includes both a light-emitter and a light sensor, a heart rate sensor, and/or other optical component. In one illustrative arrangement, optical component 72 may be used to gather information about external objects such as external object 70. For example, external object 70 may be a user's skin that rests against fabric seam 12A, and optical component 72 may detect heart rate, blood oxygen levels, color, presence, distance, and/or other information about external object 70 by gathering measurements through window 74. If desired, other types of electrical components may operate through windows 74 in fabric seam 12A. The use of an optical component is merely illustrative.

As described above, one aspect of the present technology is the gathering and use of information such as information from input-output devices. The present disclosure contemplates that in some instances, data may be gathered that includes personal information data that uniquely identifies or can be used to contact or locate a specific person. Such personal information data can include demographic data, location-based data, telephone numbers, email addresses, twitter ID's, home addresses, data or records relating to a user's health or level of fitness (e.g., vital signs measurements, medication information, exercise information), date of birth, username, password, biometric information, or any other identifying or personal information.

The present disclosure recognizes that the use of such personal information, in the present technology, can be used to the benefit of users. For example, the personal information data can be used to deliver targeted content that is of greater interest to the user. Accordingly, use of such personal information data enables users to have control of the delivered content. Further, other uses for personal information data that benefit the user are also contemplated by the present disclosure. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the United States, collection of or access to certain health data may be governed by federal and/or state laws, such as the Health Insurance Portability and Accountability Act (HIPAA), whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, the present technology can be configured to allow users to select to "opt in" or "opt out" of participation in the collection of personal information data during registration for services or anytime thereafter. In another example, users can select not to provide certain types of user data. In yet another example, users can select to limit the length of time user-specific data is maintained. In addition to providing "opt in" and "opt out" options, the present disclosure contemplates providing notifications relating to the access or use of personal information. For instance, a user may be notified upon downloading an application ("app") that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data at a city level rather than at an address level), controlling how data is stored (e.g., aggregating data across users), and/or other methods.

Therefore, although the present disclosure broadly covers use of information that may include personal information data to implement one or more various disclosed embodiments, the present disclosure also contemplates that the various embodiments can also be implemented without the need for accessing personal information data. That is, the various embodiments of the present technology are not rendered inoperable due to the lack of all or a portion of such personal information data.

The foregoing is merely illustrative and various modifications can be made by those skilled in the art without departing from the scope and spirit of the described embodiments. The foregoing embodiments may be implemented individually or in any combination.

What is claimed is:

1. An item, comprising:

a fabric having first and second fabric portions, wherein the first and second fabric portions have respective first and second overlapping edges;

a conductive strand that extends between the first and second fabric portions;

a side pocket between the first and second fabric portions;

a third fabric portion having a third edge that extends into the side pocket, wherein the third fabric portion extends past the first and second edges; and an electrical component located between the first and second fabric portions, wherein the electrical component has a groove, wherein the conductive strand is electrically coupled to the electrical component within the groove, and wherein the side pocket faces away from the electrical component.

2. The item defined in claim 1 wherein the first and second fabric portions comprise warp knit fabric layers.

3. The item defined in claim 1 further comprising adhesive that bonds the third edge to the first and second fabric portions in the side pocket.

4. The item defined in claim 1 further comprising a stitch that couples the third edge to the first and second fabric portions in the side pocket.

5. The item defined in claim 1 wherein at least one of the first and second fabric portions comprises fusible strands that have been melted to bond the third edge to the first and second fabric portions in the side pocket.

6. The item defined in claim 1 further comprising an additional side pocket between the first and second fabric portions, wherein the electrical component is interposed between the side pocket and the additional side pocket.

7. The item defined in claim 1 further comprising an array of openings in the fabric.

8. The item defined in claim 1 wherein the fabric comprises a window through which the electrical component is exposed to outside of the fabric.

9. The item defined in claim 8 wherein the electrical component comprises an optical sensor that gathers information about an external object through the window.

10. The item defined in claim 1 further comprising a gap that extends through the first fabric portion and through the second fabric portion.

11. A fabric, comprising:

first and second fabric layers having respective first and second edges that are aligned with each other;

first and second side pockets between the first and second fabric layers, wherein the first side pocket is configured to receive a third fabric portion that extends beyond the first and second edges;

a conductive strand interposed between the first and second fabric layers; and an electrical component coupled to the conductive strand between the first and second side pockets, wherein the conductive strand and the electrical component are located between the first and second side pockets.

12. The fabric defined in claim 11 wherein the first and second fabric layers comprise warp knit fabric layers.

13. The fabric defined in claim 11 wherein the electrical component comprises a groove in which the conductive strand is soldered.

14. The fabric defined in claim 11 further comprising an additional conductive strand interposed between the first and second fabric layers, wherein the conductive strand and the additional conductive strand are separated by a gap in the fabric.

15. The fabric defined in claim 14 wherein the additional conductive strand extends in a different direction than the conductive strand.

16. A fabric, comprising:

first and second fabric portions;

first and second side pockets between the first and second fabric portions;

first and second conductive strands extending between the first and second fabric portions, wherein the first and second conductive strands are separated by a gap in the first and second fabric portions, wherein the gap extends through the first and second fabric portions and separates a first strip of the first and second fabric portions from a second strip of the first and second portions, and wherein the first conductive strand is located in the first strip and the second conductive strand is located in the second strip; and an electrical component located between the first and second side pockets and interposed between the first and second fabric portions and electrically coupled to the first conductive strand.

17. The fabric defined in claim 16 wherein the first and second strips bend away from each other.

18. The fabric defined in claim 16 wherein the first and second fabric portions comprise warp knit fabric.

19. The fabric defined in claim 16 wherein the electrical component has a groove and wherein the first conductive strand is soldered to the electrical component within the groove.

* * * * *